US010228183B2

(12) United States Patent
Jung

(10) Patent No.: US 10,228,183 B2
(45) **Date of Patent: *Mar. 12, 2019**

(54) REFRIGERATOR

(71) Applicant: LG ELECTRONICS INC., Seoul (KR)

(72) Inventor: Yongki Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 98 days.

This patent is subject to a terminal disclaimer.

(21) Appl. No.: 15/264,904

(22) Filed: Sep. 14, 2016

(65) Prior Publication Data

US 2017/0082351 A1 Mar. 23, 2017

(30) Foreign Application Priority Data

Sep. 18, 2015 (KR) ..... 10-2015-0132217

(51) Int. Cl.
*A47B 96/04* (2006.01)
*F25D 23/04* (2006.01)
(Continued)

(52) U.S. Cl.
CPC ..... *F25D 23/04* (2013.01); *F25D 11/02* (2013.01); *F25D 23/025* (2013.01); *F25D 25/025* (2013.01); *F25D 2323/023* (2013.01)

(58) Field of Classification Search
CPC ..... F25D 23/02; F25D 23/04; F25D 23/025; F25D 23/028; F25D 25/025; F25D 2323/023
See application file for complete search history.

(56) References Cited

U.S. PATENT DOCUMENTS 3,488,097 A * 1/1970 Fall ..... A47B 88/493 312/334.11
7,866,772 B1 * 1/2011 Chen ..... A47B 88/493 312/334.13
(Continued)

FOREIGN PATENT DOCUMENTS

CN 101226025 7/2008
CN 101529176 9/2009
(Continued)

OTHER PUBLICATIONS

Chinese Office Action (with English translation) dated Jul. 24, 2018 issued in CN Application No. 201610825827.5.
(Continued)

*Primary Examiner* — Matthew W Ing
(74) *Attorney, Agent, or Firm* — Ked & Associates, LLP

(57) ABSTRACT

A refrigerator comprises a cabinet having a storage compartment, a main door rotatably coupled to the cabinet and opening and closing the storage compartment, a door opening provided in the main door and in communication with the storage compartment, a sub door opening and closing the door opening, and a basket assembly provided in the door opening and comprising a basket movable forward and backward, wherein the basket assembly comprises a front plate provided under the basket, a front assembly provided under the front plate and configured to move the front plate forward, a rear plate provided under the front rail assembly, and a rear rail assembly provided under the rear plate and configured to move the rear plate backward.

21 Claims, 18 Drawing Sheets

(51) Int. Cl.

| | |
|---|---|
| ***F25D 11/02*** | (2006.01) |
| ***F25D 23/02*** | (2006.01) |
| ***F25D 25/02*** | (2006.01) |

(56) References Cited

U.S. PATENT DOCUMENTS

| | | | | |
|---|---|---|---|---|
| 9,816,746 | B1 * | 11/2017 | Haney | F25D 23/028 |
| 9,915,470 | B2 * | 3/2018 | Kim | F25D 23/04 |
| 9,976,797 | B2 * | 5/2018 | Lee | A47B 88/437 |
| 2008/0168794 | A1 | 7/2008 | Cho et al. | |
| 2011/0188788 | A1 * | 8/2011 | Li | A47B 88/40 384/19 |
| 2012/0306338 | A1 * | 12/2012 | Nagahata | F25D 23/067 312/405.1 |
| 2013/0026900 | A1 * | 1/2013 | Oh | F25D 23/02 312/401 |
| 2014/0239790 | A1 * | 8/2014 | Yoo | F25D 25/025 312/404 |
| 2017/0191740 | A1 * | 7/2017 | Jung | F25D 23/04 |
| 2017/0191741 | A1 * | 7/2017 | Jung | F25D 23/04 |
| 2017/0219275 | A1 * | 8/2017 | Suh | F25D 25/025 |

FOREIGN PATENT DOCUMENTS

| | | |
|---|---|---|
| CN | 102478343 | 5/2012 |
| CN | 106605114 | 4/2017 |
| JP | 3106781 | 1/2005 |
| KR | 10-2008-0016026 | 2/2008 |
| KR | 10-2008-0067409 | 7/2008 |
| KR | 10-2012-0054848 | 5/2012 |
| KR | 10-2014-0105687 | 9/2014 |

OTHER PUBLICATIONS

European Search Report dated Jan. 16, 2017 issued in Application No. 16188258.4.

* cited by examiner (a)

(b)

(a)

(b)

(a)

(b)

REFRIGERATOR

CROSS-REFERENCE TO RELATED APPLICATION(S)

Pursuant to 35 U.S.C. § 119(a), this application claims the benefit of earlier filing date and right of priority to Korean Application No. 10-2015-0132217, filed on Sep. 18, 2015, the contents of which are hereby incorporated by reference herein in their entirety.

BACKGROUND

1. Field

The present disclosure relates to a refrigerator, and more particularly to a refrigerator including a basket.

2. Background

A refrigerator may be an electric appliance which provides cold air to stored objects, for example, food stuffs to preserve them at lower temperatures than normal temperatures. A freezing cycle configured of compression, condensation, expansion and evaporation may be used in generating such cold air. A conventional refrigerator may include one or more storage compartments storing food stuffs; one or more doors opening and closing the one or more storage compartments; a basket provided in the one or more doors; and a basket cover opening and closing a top of the basket so that a user may store objects including food stuffs and beverages in the basket.

However, such a conventional basket may be fixed to the door and it may be inconvenient for the user to take out the objects stored deep inside the basket. The door of the conventional refrigerator may include a main-door opening and closing the storage compartment and a sub-door opening and closing a predetermined front portion of the main door. The basket may be provided in the main door. The user may then be able to take out the objects stored in the basket provided in the main door through a front side of the main door, after having opened the sub-door. However, it may also be difficult to take out the objects stored in the basket through a back side of the main door.

BRIEF DESCRIPTION OF THE DRAWINGS

Embodiments will be described in detail with reference to the following drawings in which like reference numerals refer to like elements, and wherein.

DETAILED DESCRIPTION

Use of such terminology herein is merely intended to facilitate description of the specification, and the terminology itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Figure 1:
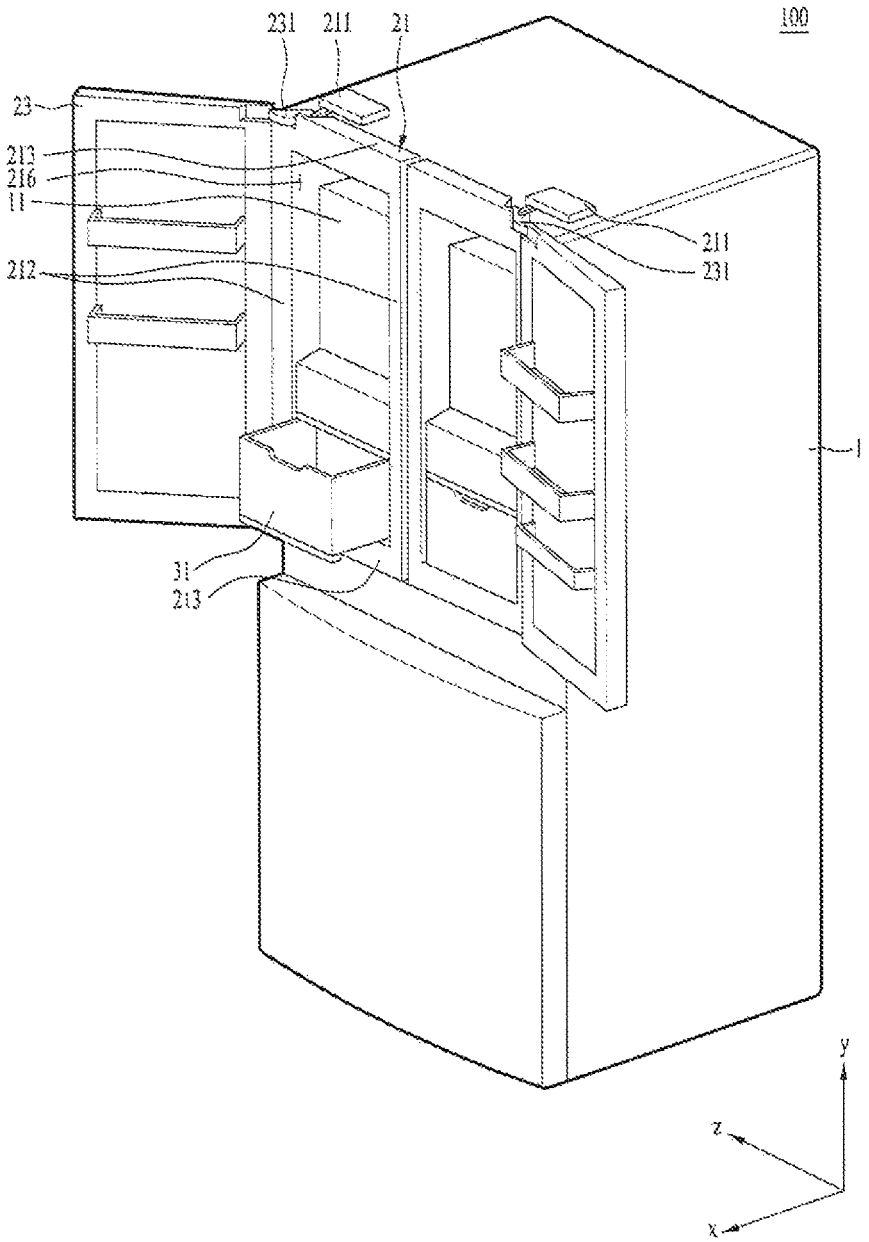
FIG. 1 is a perspective diagram illustrating a refrigerator according to exemplary embodiments.

As shown in FIG. 1, the refrigerator 100 according to the illustrated embodiment may include a cabinet 1 having a storage compartment 11; a main door 21 that opens and closes the storage compartment 11; a door opening 216 provided in the main door 21 and in communication with the storage compartment 11; and a sub-door 23 that opens and closes the door opening 216. The cabinet 1 may define an exterior appearance of the refrigerator and the exterior appearance or profile of a conventional refrigerator may be cube-shaped. However, the shape of the cabinet 1 is not limited thereto and it may be diversely determined.

A cabinet opening may be provided in a front portion of the cabinet 1 to allow the storage compartment 11 to communicate with the outside of the cabinet. The storage compartment 11 may include a freezer compartment provided with cold air generated by a freezing cycle to preserve food stuffs or beverages at temperatures under zero and a refrigerator compartment kept at preset temperatures lower than normal temperatures but above zero.

The refrigerator 100 shown in FIG. 1 has the refrigerator compartment provided on top of the freezer compartment. As alternative examples, the refrigerator may have the freezer compartment provided at a left side and the refrigerator compartment provided at a right side with respect to a partition wall. The main door 21 may be rotatably coupled to the cabinet 1 to open and close the cabinet opening and allow the storage compartment 11 to communication with the outside. The main door 21 may be rotatably connected to the cabinet opening 12 by a main hinge 211.

The door opening 216 may penetrate a center of the main door 21 so that the internal space of the storage compartment 11 may communicate with the outside even when the main door 21 is closed. Specifically, the main door 21 have two vertical frames 212 provided at two sides, respectively, and two horizontal frames 213 connecting the two vertical frames 212 with each other. The main door may be formed by the connected vertical and horizontal frames 212 and 213 in a rectangular shape. The door opening 216 may be empty space defined by the vertical and horizontal frames 212 and 213 connected with each other.

The sub-door 23 may be rotatably coupled to the main door 21 to open and close the door opening 216. The sub-door 23 may be connected to the main door 21 by a sub-hinge 231. When the user opens the main door 21, the main door 21 may be rotated together with the sub-door. When the user opens the sub-door 23, only the sub-door 23 may open while the main door 21 remains closed.

Meanwhile, the refrigerator may further include a door storage 11*a* provided in the main door 21. The door storage 11*a* may be arranged in the door opening 216. The door storage 11*a* may be rotated together with the main door 21 according to the opening and closing of the main door 21. The door storage 11*a* may be accessible through the door opening 216 by the user when the sub-door 23 is open.

The user may be able to store favorite beverages in the door storage 11*a*, and take out and drink one of the beverages after opening only the sub-door 23. Accordingly, the leakage of the cold air from the storage compartment 11 outside may be minimized when the main door 21 is open.

Figure 2:
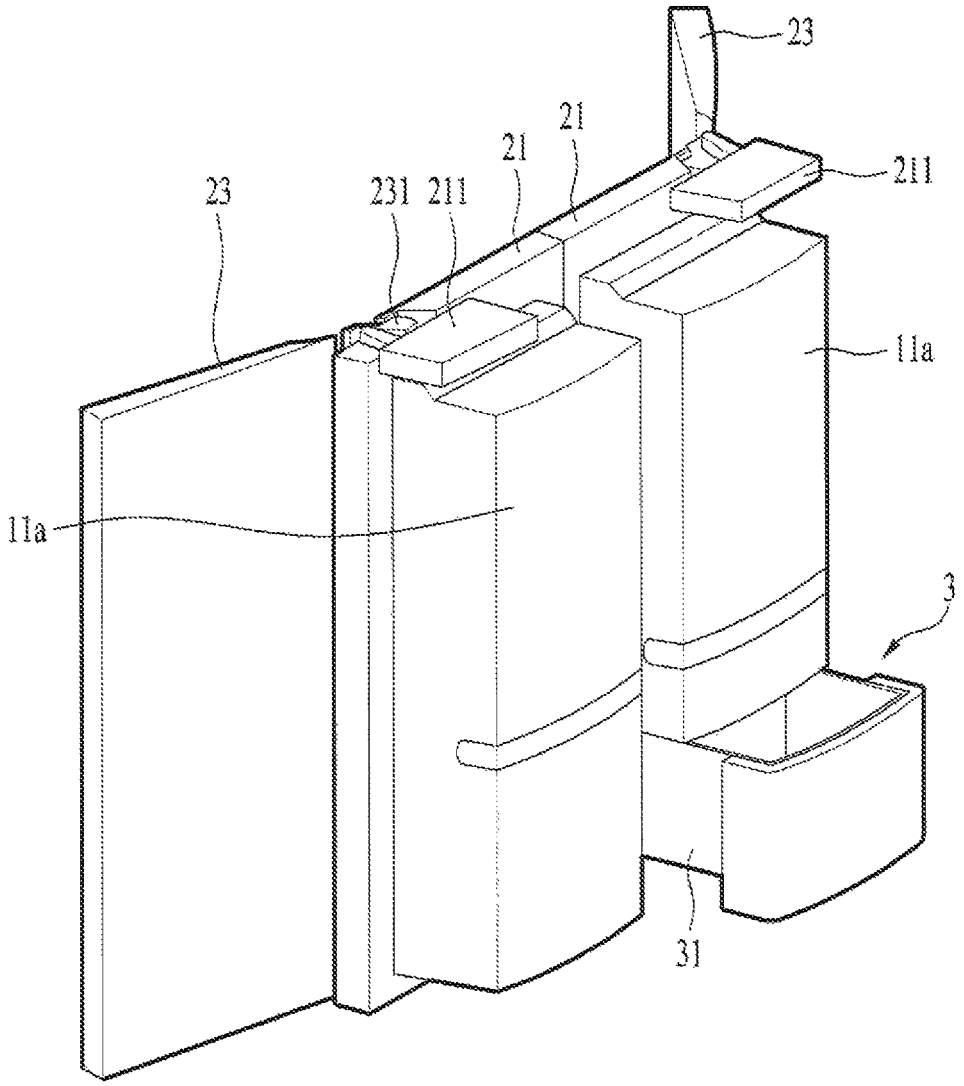
FIG. 2 illustrates a door provided in the refrigerator according to the embodiment.
Figure 3:
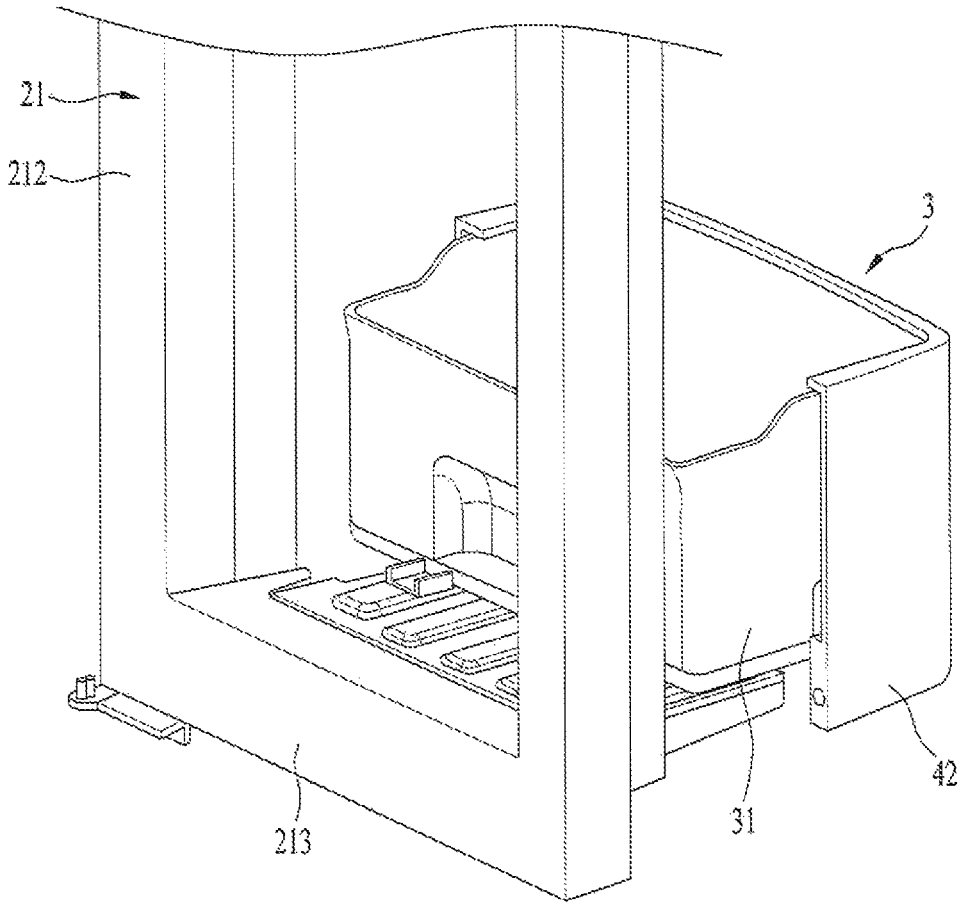
FIG. 3 illustrates a state where a basket is taken out backward.
Figure 4:
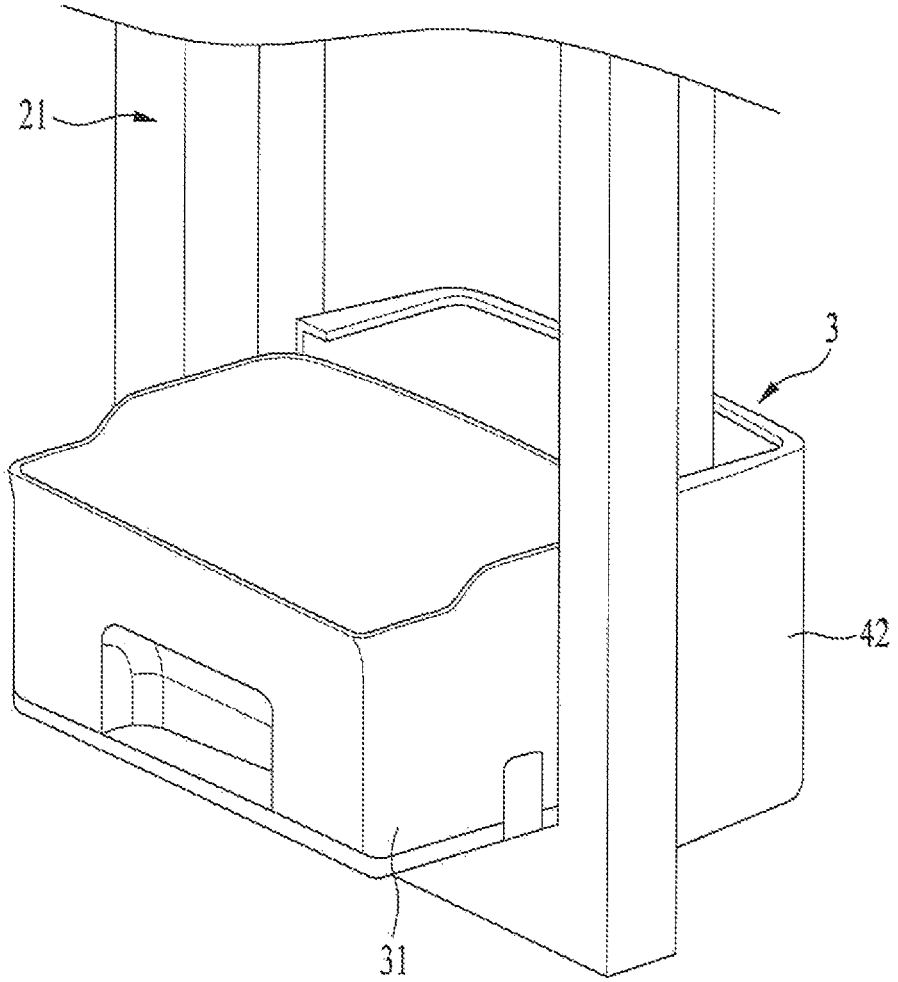
FIG. 4 illustrates a state where the basket is taken out forward.

Referring to FIGS. 2 through 4, the refrigerator may further include a basket assembly 3 provided in the door opening 216 and including a basket 31 which may be movable forward and backward. As shown in FIGS. 2 and 3, the basket 31 provided in the main door 21 may be movable backward in a state where the main door 21 is open. When the sub-door 23 is open and the main door 21 is closed as shown in FIG. 4, the basket 31 may be movable forward.

The user may move the basket 31 forward after opening only the sub-door 23 and backward after opening the main door 21, to take out the objects stored in the basket 31. When the basket 31 is provided in the refrigerator compartment door, the user may store fruits or vegetables in the basket 31. When the basket 31 is provided in the freezer compartment door, the user may store food that requires freezing such as meat and seafood.

Figure 5:
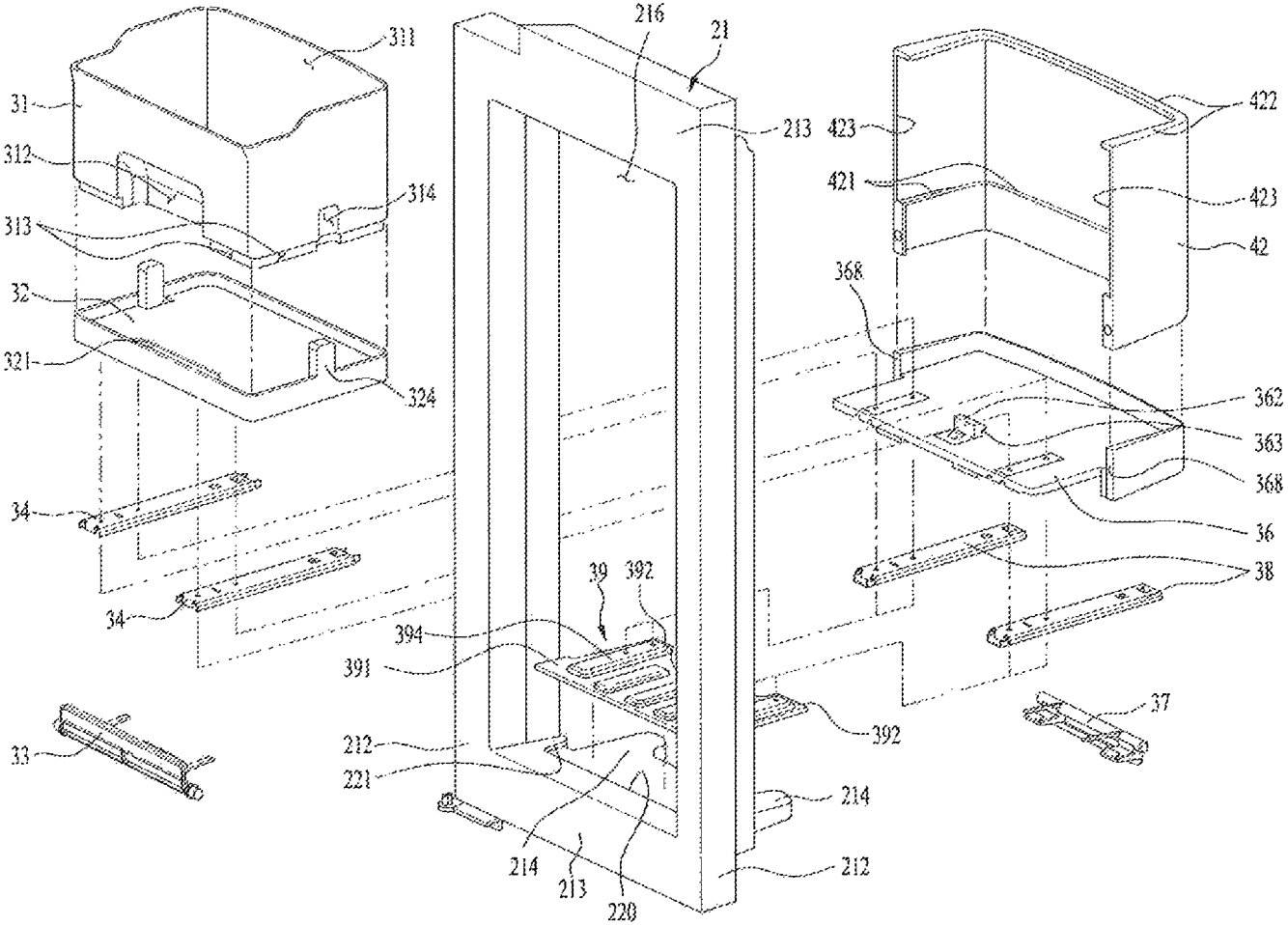
FIG. 5 is an exploded perspective diagram of a basket assembly.
Figure 6:
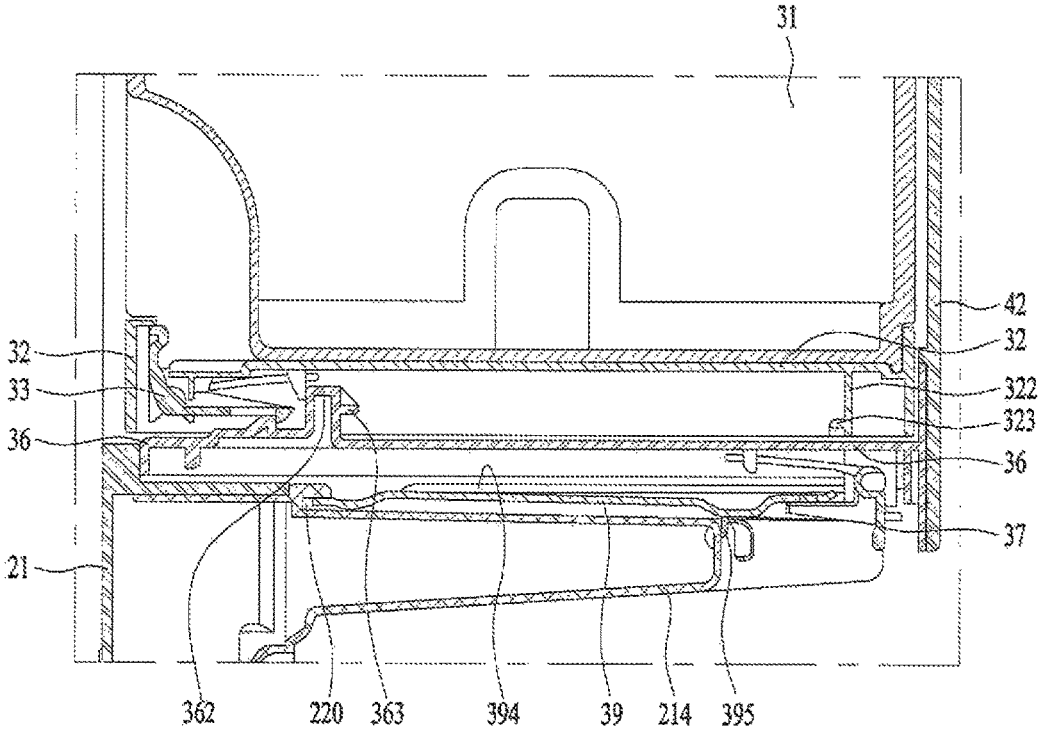
FIG. 6 is a sectional diagram of the door.

As shown in FIG. 5, the basket assembly 3 may include a front plate 32 provided of a bottom of the basket 31; a front rail assembly 34 to slidingly move the front plate 32 forward; a rear plate 36 provided under the front rail assembly; and a rear rail assembly 38 to slidingly move the rear plate 36 backward. When the user moves the basket 31 backward, the rear plate 36 and the front plate 32 may be moved backward at the same time. When the user moves the basket 31 forward, only the front plate 32 is moved forward. Although not shown in the drawings, an alternative example of the basket assembly may include a first plate provided under the basket and movable backward; a rear rail assembly provided under the first plate; a second plate provided under the first plate and movable forward; and a front rail assembly provided under the second plate.

The basket assembly 3 may be provided at a lower end portion of the door opening 216 of the main door 21. The rear rail assembly 38 may be provided at the bottom of the door opening 216. The door storage 11*a* may be arranged at an upper portion of the door opening 216 of the main door 21, and the basket assembly 3 may be arranged at a lower portion of the door opening 216.

If the load of the basket 31 is increased, the torque applied to the lower portion of the door opening 216 may be increased when the basket 31 is moved forward. It may be necessary to reinforce the structure of the lower portion of the door opening 216 to bear the load of the basket 31. Thus, the refrigerator may further include a support 214 projected from the main door 21 backward.

The basket 31 may be arranged on the support 214 and supported by the support 214. The support 214 may be integrally formed with the main door 21 to reinforce rigidity of the support 214.

The main door 21 may include a case that defines an exterior appearance of the refrigerator and a heat insulating material filled in the case. The support 214 may be integrally injection-molded with the case as one body, and the heat insulating material may be a material such as polyurethane form.

The support 214 and the case may be made of plastic, preferably ABS resin. The main door 21 may disperse the load of the basket assembly 3 toward a top surface of the support 214 so that the rigidity of the main door 21 may be reinforced.

A reinforcing plate 39 may be further provided in the refrigerator. The rear rail assembly 38 may be secured to a top surface of the reinforcing plate 39.

The support 214 may be made of plastic and the heat insulating material such as polyurethane form may be filled therein. Even if the basket assembly 3 is fastened to the top surface of the support 214 by a screw, the fastening is likely not to be fixedly solid. To solve the disadvantage, the reinforcing plate 39 may be provided and the basket assembly 3 may be detached from the support 214 according to the opening of the main door 21.

The reinforcing plate 39 may be made of metal or reinforced plastic. To prevent the basket from falling down by the load when the basket is sliding forward or backward, the basket connection with the door and the load dispersion may be improved by using the reinforcing plate 39.

The reinforcing plate 39 may include a reinforcing rib 394 to reinforce the rigidity. The reinforcing rib 394 may be convexly projected from a top surface of the reinforcing plate 39 and longitudinally formed in a back and forth or horizontal direction.

A first fixing groove 220 fixing the reinforcing plate 39 to the support 214 may be further provided in the refrigerator. The first fixing groove 220 may be provided in an upper portion of the support 214 and concavely recessed.

The reinforcing plate 39 may be provided on the top surface of the support 214. When the user pushes the reinforcing plate 39 forward, one end of the reinforcing plate 39 may be insertedly fixed in the first fixing groove 220. Even if the basket 31 is sliding backward, the end of the reinforcing plate 39 may be supported in the first fixing groove 220.

A second fixing groove 221 concavely recessed from a side of the support 214 may be further provided in the refrigerator. The reinforcing plate 39 may include first wings 391 extending from both right and left sides. The first wing 391 may be inserted in the first fixing groove 220 so that a lateral end of the reinforcing plate 39 as well as the front end can be fixedly supported by the second fixing groove 221.

A hook 395 may be further provided at the reinforcing plate 39 of the refrigerator. The hook 395 may be projected from a bottom surface of the reinforcing plate 39 and fixed to one side of the support 215. The hook 395 may be provided at a rear portion of the reinforcing plate 39.

The front portion of the reinforcing plate 39 may be fixed by the first fixing groove 220 and the lateral portion of the reinforcing plate 39 may be fixed by the second fixing groove 221. The rear portion of the reinforcing plate 39 may be fixed to the support 214 by the hook 395. Accordingly, the reinforcing plate 39 may bear the load of the basket 31 stably secured to the support 214 to sliding move forward and backward.

Figure 7:
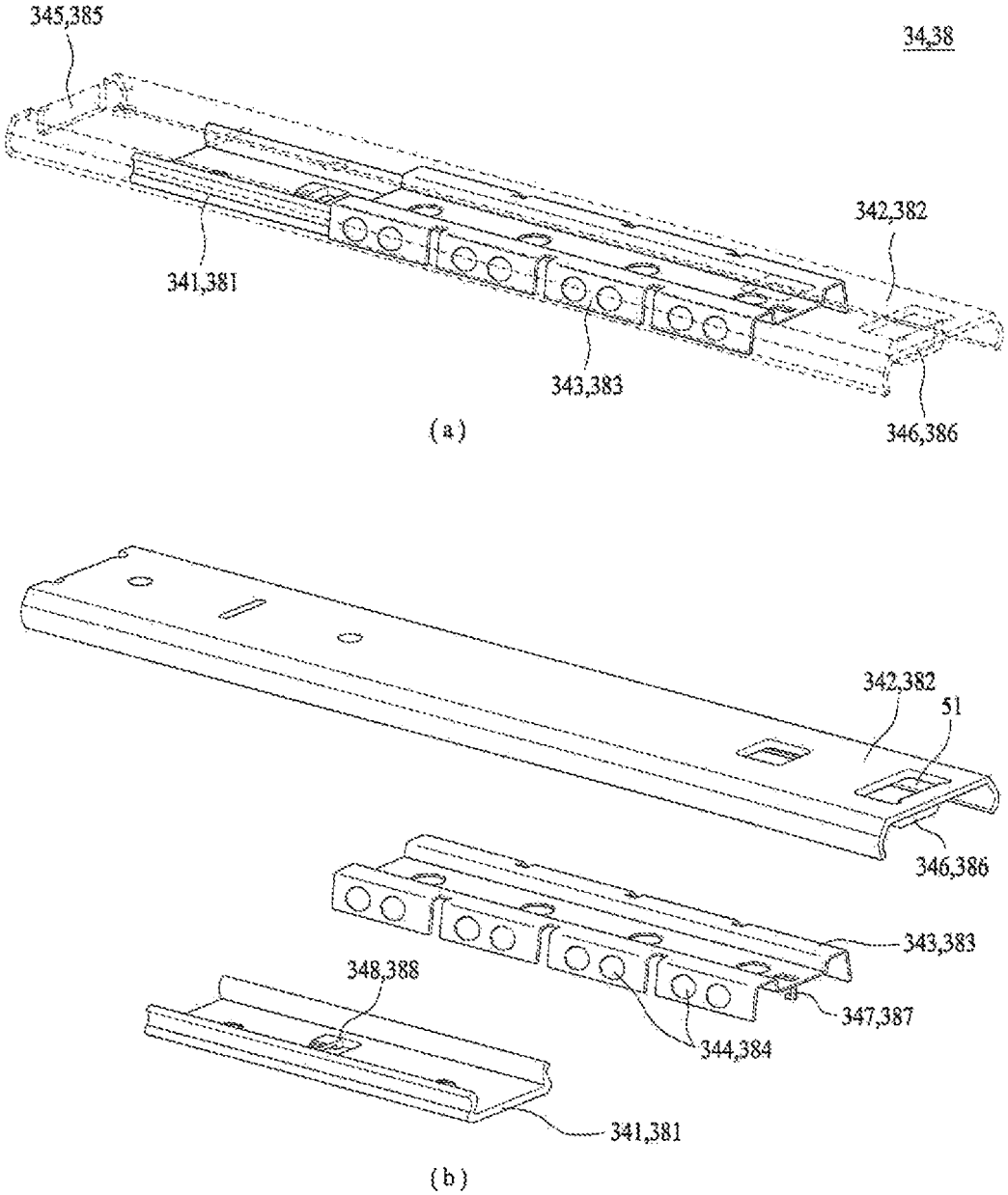
FIG. 7 illustrates a rail assembly.

Referring to FIG. 7, the front rail assembly 34 may include a front first rail 341 having a ⊏-shaped cross sectional area; a front second rail 342 provided in the front first rail 341 and having a larger ⊏-shaped cross sectional area; and a front third rail 343 having a ball bearing 344 arranged between the front first rail 341 and the front second rail 342. The rear rail assembly 38 may include a rear first rail 381 having a ⊏-shaped cross sectional area; a rear second rail 382 provided in the rear first rail 381 and having a larger ⊏-shaped cross sectional area; and a rear third rail 383 having a ball bearing 384 arranged between the front first rail 381 and the front second rail 382.

The front rail assembly 34 may be formed in the same shape as the rear rail assembly 38. Accordingly, following description is applicable to both of the front and rear rail assemblies and the terminology of 'front' and 'rear' will be omitted. For example, the front first rail 341 and the rear first rail 381 will be referenced to as 'the first rail', and the front second rail 342 and the rear second rail 382 will be referenced to as 'the second rail'. The front third rail 343 and the rear third rail 383 will be described as 'the third rail'.

The ball bearing 344 and 383 may be in contact with the first rail and the second rail. Lubricant such as oil may be provided in the portion in contact with the first rail and the second rail so as to minimize frictional force.

The first rail 341 and 381 may be fixed to a fixed end and the second rail 342 and 382 may be fixed to a free end. In other words, an object corresponding to the free end may be secured to the second rail 342 and 382 and an object corresponding to the fixed end may be secured to the first rail 341 and 381.

The first rail 341 and 381, the second rail 342 and 383, and the third rail 343 and 383 may be arranged longitudinally in a direction of the sliding movement. The first rail 341 and 381 may be shorter than the second rail 342 and 382. The third rail 343 and 383 may be shorter than the second rail 342 and 382. Accordingly, the exposed portion of the first rail 341 and 381 once the second rail 342 and 382 guided by the first rail 341 and 381 and the third rail 343 and 383 moved out completely may be minimized.

The second rail 342 and 382 may include a first rail stopper 345 and 385 and a second rail stopper 346 and 386 which may project from either side of the second rail inward to prevent the third rail 343 and 383 movable in the second rail 342 and 382 from becoming exposed outside. The movement of the third rail 343 and 383 is restricted by the first rail stopper 345 and 385 and the second stopper 346 and 386, only to be movable only within the second rail 342 and 382.

The rail assembly may further include a third rail stopper 347 and 387 provided in the third rail 343 and 383; and a fourth rail stopper 348 and 388 provided in the third rail 341 and 381 to restrict the movement of the third rail stopper 347 and 387. The third rail stopper 347 and 387 may be a projection or a hook projected from the third rail 343 and 383 toward the first rail 341 and 381. The fourth rail stopper 348 and 388 may be a ring to which the projection projected from the first rail 341 and 381 toward the third rail 343 and 383 or the hook is insertedly hooked.

The maximum distance of the second rail 342 and 382 movement may be determined by the location of the fourth rail stopper 348 and 388 in the first rail 341 and 381 and the location of the third rail stopper 347 and 381 in the third rail 343 and 383. In other words, the distance in which the third rail 343 and 383 is moved outward from the first rail 341 and 381 may be set as the maximum distance in which the second rail 342 and 382 is moved outward.

The third rail stopper 347 and 387 may be provided at a first end of the third rail 343 and 383. The fourth rail stopper 348 and 388 may be provided near the center of the first rail 341 and 381. The first end of the third rail 343 and 383 may be the opposite of the direction in which the second rail 342 and 382 is moved out. In other words, it may be the rear portion of the third rail 343 and 383 in the front rail assembly 34 and the front portion of the third rail 343 and 383 in the rear rail assembly 38.

The first rail 341, 381 of the rail assembly 36 and 38 may be fastened to the fixed end (the rear portion: the support 214 or the front portion: the top surface of the rear plate 36) by a bolt. The second rail 342 and 382 may be fastened to the free end (the rear portion: the bottom surface of the rear plate 36 or the front portion: the bottom surface of the front plate 32) by a bolt.

the second rail 342 and 382 may include a fixing projection 50 (see FIG. 16) projecting from a bottom surface of the free end and including a step, so as to reduce the fastening frequency between the free end and the second rail 342 and 382; and a projection groove 51 receiving the fixing projection 50 to fix the step thereto. A worker may insertedly fit the fixing projection 50 of the free end in the projection groove 51 of the second rail 342 and 382 and fasten the second rail 342 and 382 to the bottom surface of the free end, using a screw, only to facilitate the assembling process.

Two rail assemblies may be applied to each direction of the rail assembly, and a total of 4 rail assemblies may be provided. Alternatively, more than 4 rail assemblies may be provided.

If the door is opened and closed when there is a load of the basket, there may be certain flow which is generated in the basket by inertia. A lever to fix the basket may be provided to prevent sliding of the basket not intended by the user. The user may release the fixing of the lever to slidingly move out forward or backward.

Figure 8:
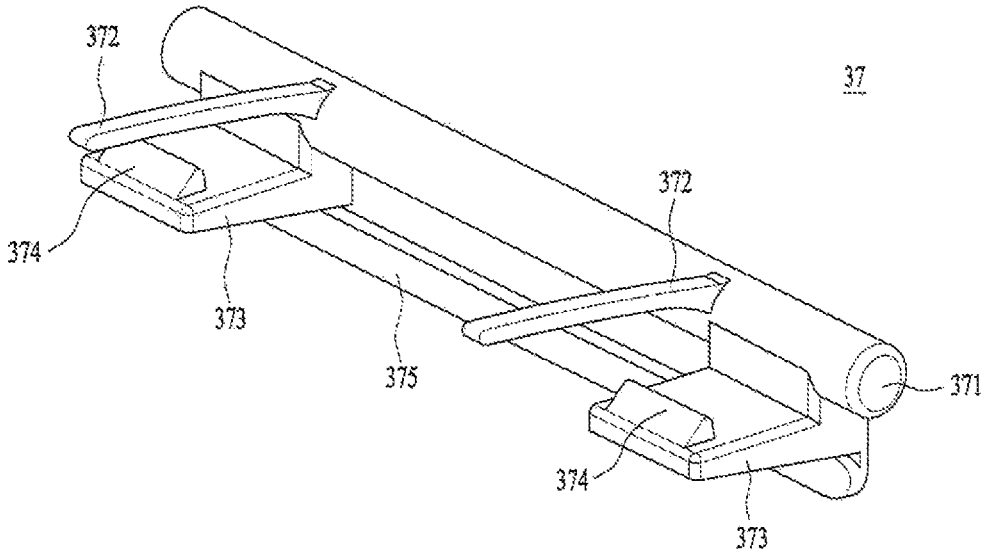
FIG. 8 illustrates a rear lever.
Figure 8:
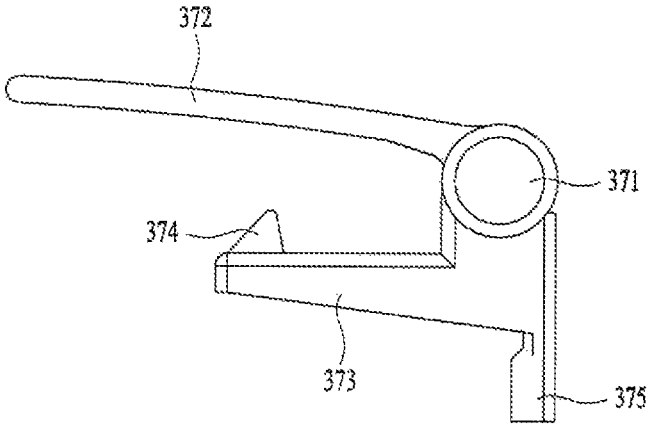
Figure 9:
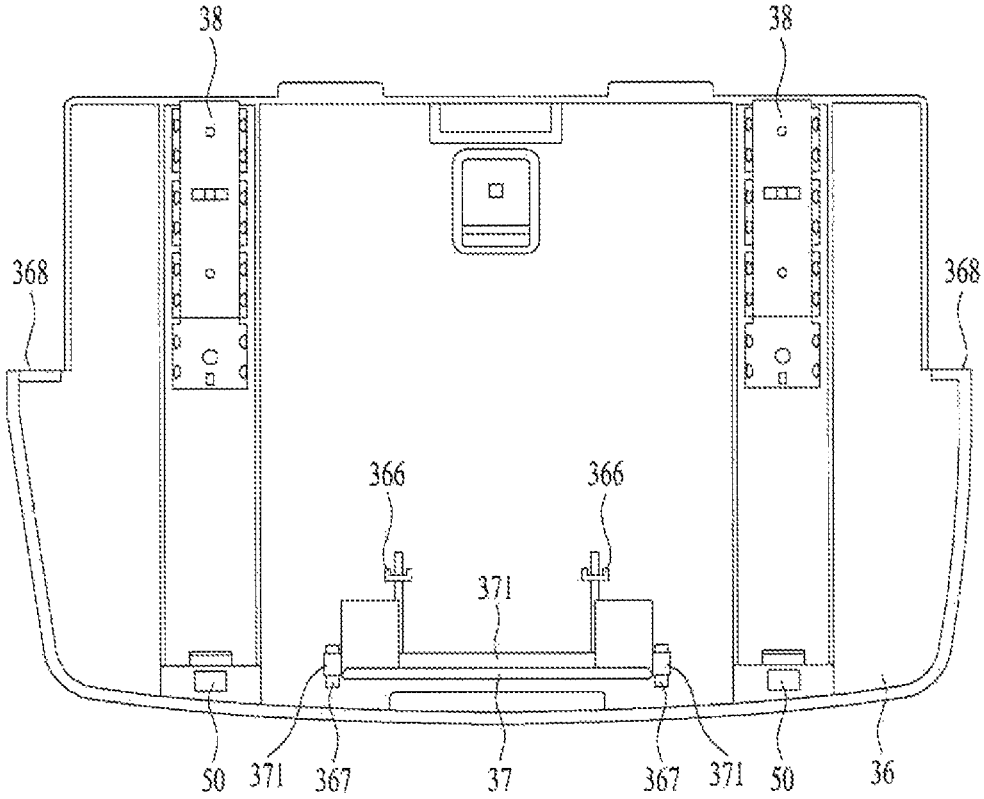
FIG. 9 illustrates a bottom surface of a rear plate.

According to FIGS. 8 and 9, the refrigerator may further include a rear lever 37 fixing the rear plate 36 to prevent the rear plate 36 from moving backward by inertia when the user opens the main door 21. When the user applies force to the rear lever 37 to move out the basket 31 backward, the fixing of the rear lever may be released and the basket 31 is in a state of getting movable backward.

The rear lever 37 may include a rear shaft 371; a rear elastic lever 372 extended from the rear shaft 371 and fixed to the rear plate 36; a rear fixing lever 373 extended from the rear shaft 371 and forming a preset second angle with the rear elastic lever 372; and a rear lever projection 374 provided in the rear fixing lever 373 and selectively fixed to the main door 21. The rear shaft 371 shown in FIG. 9 may be fixed by a rear shaft fixing portion 367 provided in the bottom surface of the rear plate 36. The rear shaft fixing portion 367 may be provided in a C-shape and the rear shaft may be forcibly fitted in a C-shaped opening of the rear shaft fixing portion.

The rear elastic lever 372 may be flexible by a weak force and made of an elastic material to have a restoring force. The rear elastic lever 372 may be fixed to the rear elastic lever fixing portion 366 provided in the bottom surface of the rear plate 36. Referring to FIG. 9, the rear elastic lever fixing portion 366 may be formed in a ring shape having open ends.

The rear lever 37 may further include a rear handle 375 extending from the rear shaft 371 and provided as a handle for the user. The rear handle 375 may extend from the rear shaft 371 downward and may be connected to the rear fixing lever 373 more strongly than the rear elastic lever 372.

The rear fixing lever 373 may extend from one surface of the rear handle 375 extended from the rear shaft 371. An extension line from the rear elastic lever 372 meets an extension line from the rear handle 375 at a center axis of the rear shaft 371. An extension line from the rear fixing lever 373 may not pass the center axis of the rear shaft 371.

Two rear fixing levers 373 may be provided at either end of the rear shaft 371, respectively, and two rear elastic levers 372 spaced a preset distance apart may be provided between the two rear fixing levers 373. The user may apply force to the rear handle 375 through the space between the two rear elastic levers 372.

Figure 10:
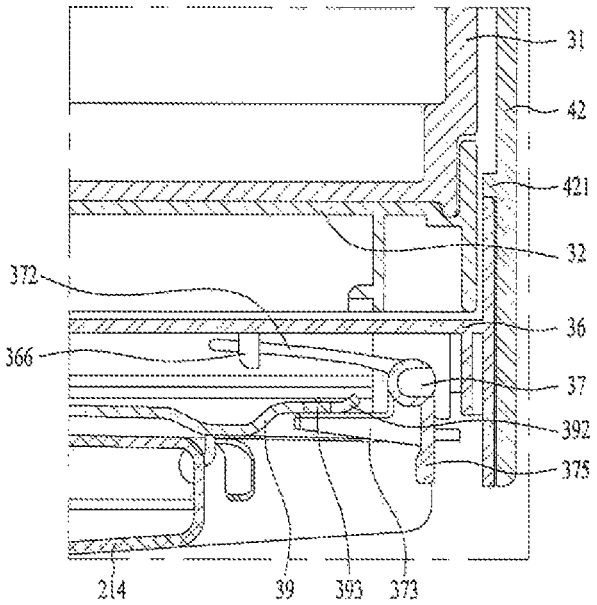
FIG. 10 illustrates the operation of the rear lever to take out the basket backward.
Figure 10:
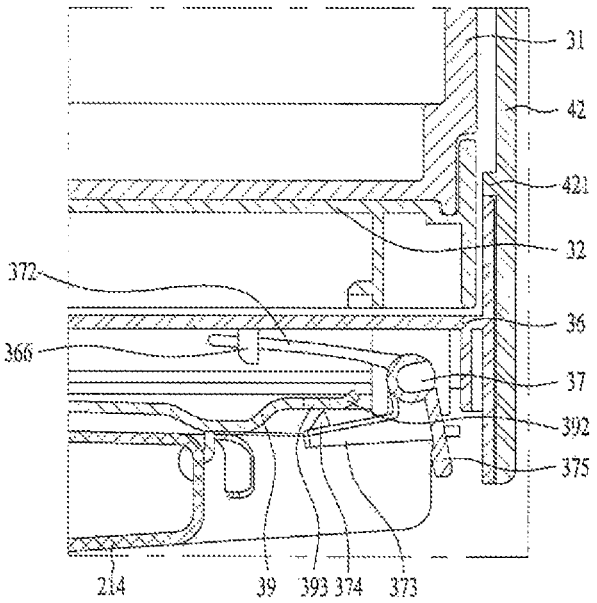

As shown in FIG. 10, the rear lever projection 374 may project upward at a slope and may be fixedly inserted in a rear lever fixing hole 393 provided in the support 214 or the reinforcing plate 39. If provided in the reinforcing plate 39, the rear lever fixing hole 393 may be provided in the second wing extended from the reinforcing plate 39 backward (see FIG. 5).

A rear end of the second wing 392 may be upwardly inclined. When moving out backward and then in forward, the rear lever projection 374 may not be hooked to the end of the second wing 392 and smoothly inserted in the rear lever fixing hole 393.

As shown in FIG. 10 (*a*), the basket 31 may be secured to the main door 21 by the rear lever 37. The rear lever projection 374 of the rear fixing lever 373 may be inserted in the rear lever fixing hole 393 not to move out backward. Even if the main door 21 is open and rotated, the basket 31 may not be moved out backward by inertia.

As shown in FIG. 10 (*b*), the second angle between the rear fixing lever 373 and the rear elastic lever may 372 become wider when an external force is applied to pull the rear handle 375 backward. In this instance, the rear fixing lever 373 may be rotated downward and the rear lever projection 374 may be released from the rear lever fixing hole 393 to move the rear plate 36 backward.

Figure 11:
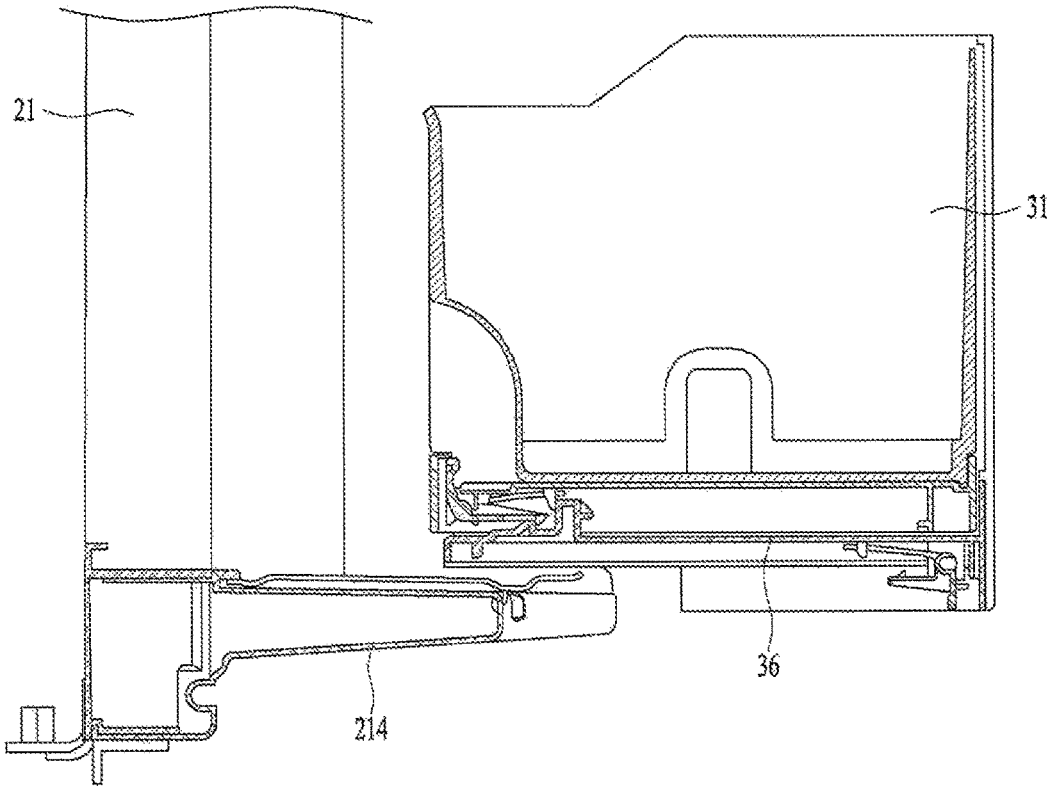
FIG. 11 illustrates a state where the basket is taken out backward.

As shown in FIG. 11, the rear first rail 381 may be fixed to the reinforcing plate 39 and the rear second rail 382 may be fixed to the bottom surface of the rear plate 36 in the rear rail assembly 38, so that the rear second rail 382 may be guided by the first rail 381 and slid backward. The rear plate 36 may be moved out backward as far as the maximum of the rear second rail 382, which may be equal to the maximum distance of the basket 31 moved out backward.

In contrast, the operation of the basket 31 re-moving inward to the main door 21 after moving out backward will be described. When the basket 31 moved out backward is pushed forward, the rear second rail 382 provided in the bottom surface of the rear plate 36 may be guided and slid forward by the rear first rail 381.

The refrigerator may further include a movement preventing rib 368 provided in the rear plate 36 to prevent the rear plate 36 from moving inward to the door opening 216 (see FIG. 9). The movement preventing rib 368 may prevent the rear plate 36 from moving forward after passing through the door opening 216.

The movement preventing rib 368 may project from a lateral surface of the rear plate 36. The rear plate 36 may be moved into the door opening 216 and then hooked by the movement preventing rib 368 provided at a rear surface of the door 21, so that the rear plate 36 cannot be moved forward completely.

As an alternative example, the movement preventing rib 368 may extend from the lateral surface of the rear plate 36 toward the rear surface and extend toward the top. Accordingly, the movement preventing rib 368 may function as a kind of a stopper to prevent the front plate 32 and the basket 31 provided over the rear plate 36 from moving backward (see FIG. 5).

As another alternative example, the movement preventing rib 368 may extend from the lateral surface to the rear surface and extend downward. In this instance, the movement preventing rib 368 may function as a kind of cover to cover the rear rail assembly 38 and the rear lever 37 provided under the rear plate 36 so as not to be visible by the user from the backside of the door 21 (see FIG. 5).

Referring to FIG. 5, the refrigerator may further include a basket rear surface cover 42 to cover the rear surface of the basket 31. The shape of the basket rear surface cover 42 may cover the overall rear surface of the basket 31 and some area of the lateral surface of the basket 31. The horizontal section of the basket rear surface cover 42 may be '⊏'-shaped.

The basket rear surface cover 42 is provided around the rear plate 36 and cover an outer circumferential surface of the movement preventing rib 368. The basket rear surface cover 42 shown in FIG. 4 may communicate with the storage compartment via a back portion of the basket 31 to prevent the leakage of cold air.

The basket rear surface cover 42 may include a first edge 421 projecting from an inner circumferential surface in a horizontal direction; a second edge horizontally provided at a top of the inner circumferential surface; and a third edge vertically provided at a front portion of the inner circumferential surface. The first edge 421 is may be supportedly arranged over the movement preventing rib 368 and the second edge 422 may cover an upper end of the basket 31. The third edge 423 may cover the portion where the movement preventing rib 368 contacts with the main door 21.

Figure 12:
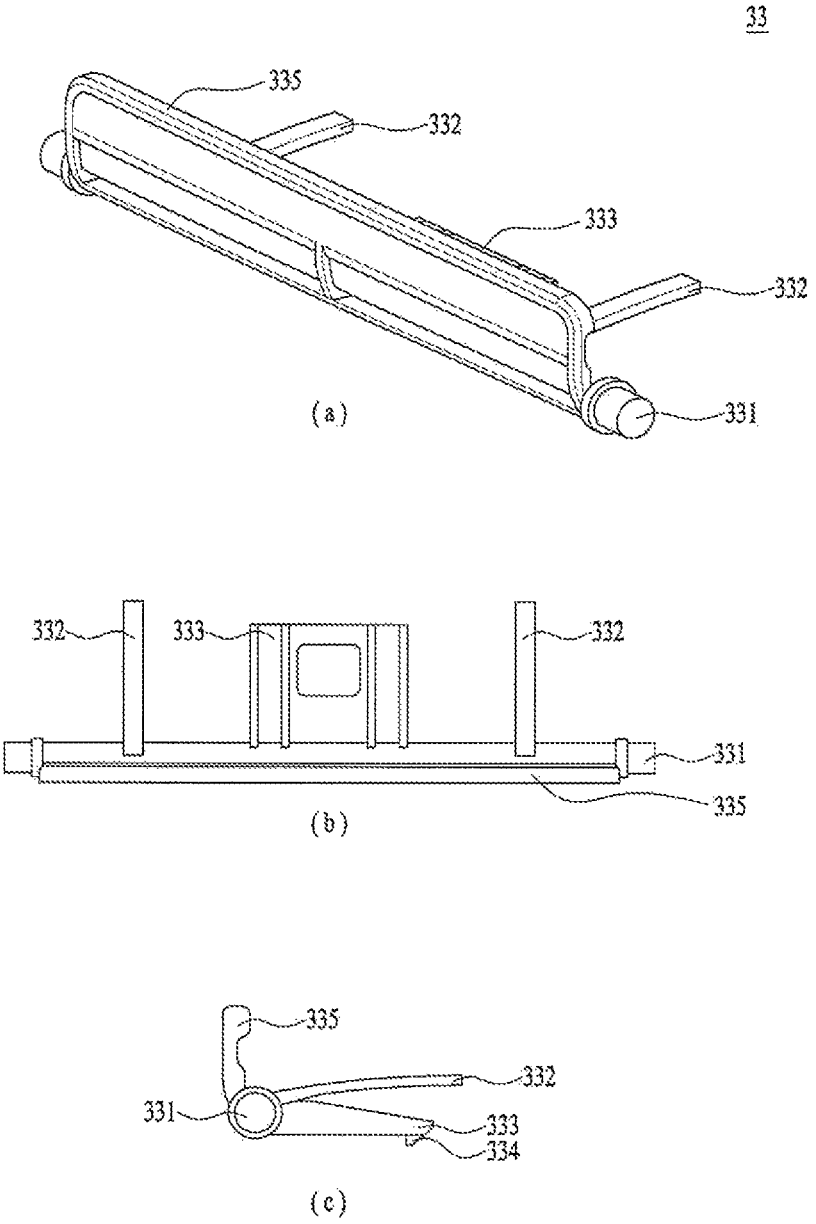
FIG. 12 illustrates a front lever.
Figure 13:
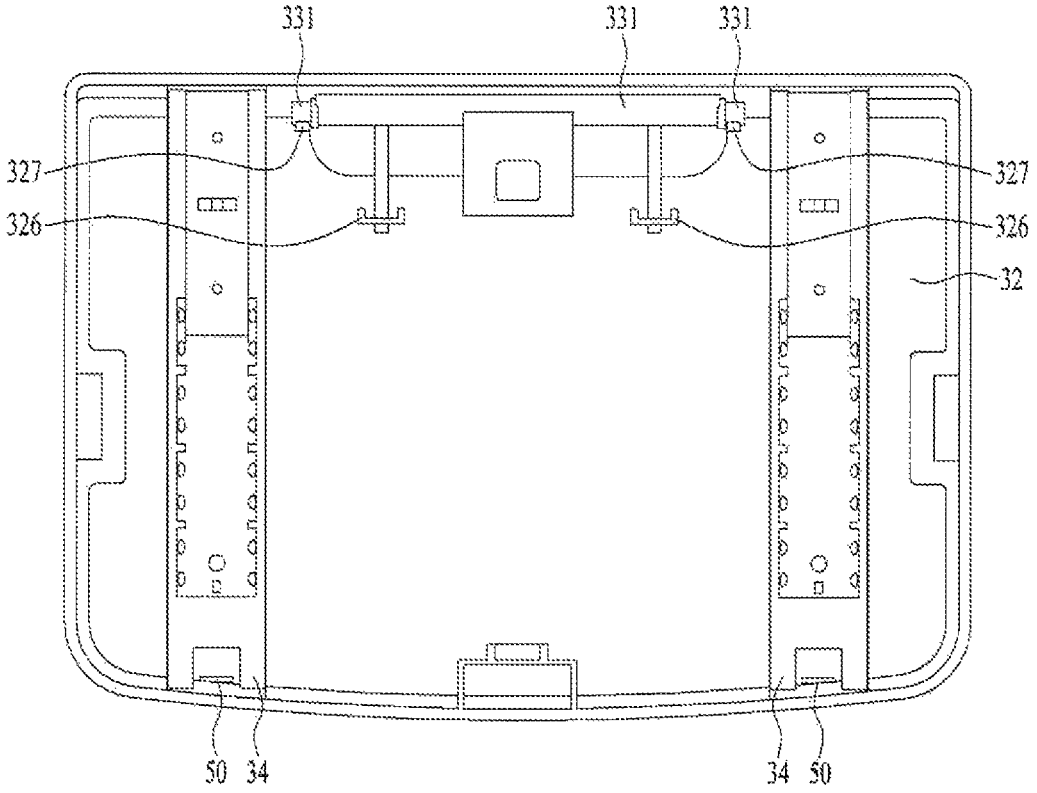
FIG. 13 illustrates a bottom surface of a front plate.

According to FIGS. 12 and 13, the refrigerator may further include a front lever 33 fixing the front plate 32 to prevent the movement or shaking of the front plate 32. The user may apply force to the front lever 33 and release the front plate 32, so as to move the basket 31 forward.

The front lever 33 includes may include a front shaft 331; a front elastic lever 332 extending from the front shaft 331 and fixed to the front plate 32; a front fixing lever 333 extending from the front shaft 331 and forming a preset first angle with the front elastic lever 332; and a front lever projection 334 provided in the front fixing lever 333 and selectively fixed to the rear plate 36. The front shaft 331 shown in FIG. 13 may be fixed by a front shaft fixing portion 327 provided in the bottom surface of the front plate 32. The front shaft fixing portion 327 may have a C-shape and the front shaft 331 may be forcibly fitted in the C-shaped opening of the rear shaft fixing portion.

The front elastic lever 332 may be flexible by a weak force and made of an elastic material to have a restoring force. The front elastic lever 332 may be fixed to the front elastic lever fixing portion 326 provided at the bottom surface of the front plate 32. Referring to FIG. 13, the front elastic lever fixing portion 326 may be formed in a ring shape having open ends.

The front lever 33 may further include a front handle 335 extending from the front shaft 331 and provided as a handle for the user. The rear handle 335 may extend from the front shaft 331 downward and connect to the front fixing lever 333 more strongly than the front elastic lever 332.

An extension line from the front elastic lever 332 may meet an extension line from the front handle 335 at a central axis of the front shaft 331. An extension line from the front fixing lever 333 may also pass the central axis of the front shaft 371.

Two front elastic levers 332 may be provided at either end of the front shaft 331, respectively, and the front fixing lever 333 may be provided between the two front elastic levers 332. The front fixing lever 333 may be provided in the center of the front shaft 331 and the front elastic levers 332 may be provided at either ends of the front shaft 331, respectively.

Figure 14:
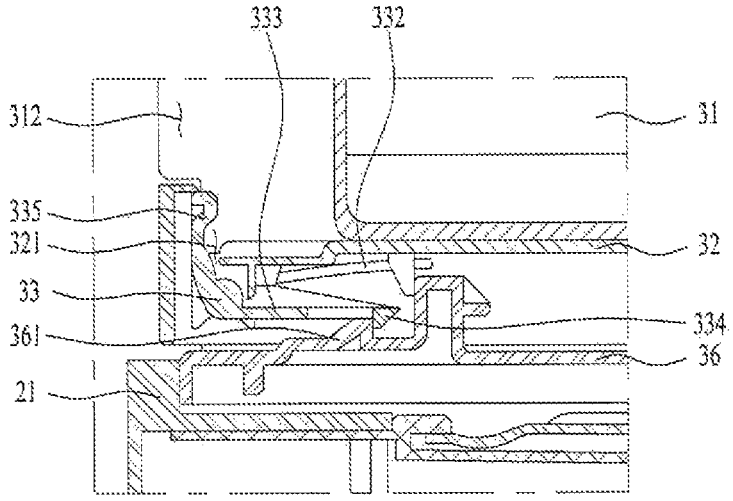
FIG. 14 illustrates the operation of the front lever to take out the basket forward.
Figure 14:
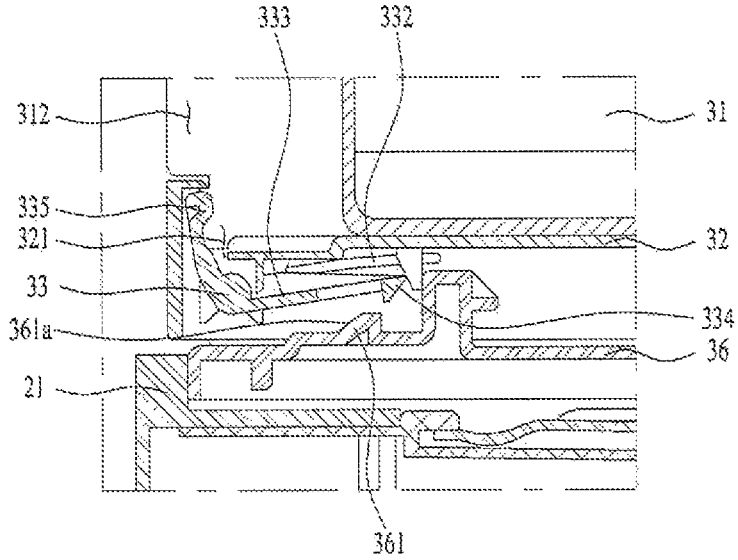
Figure 15:
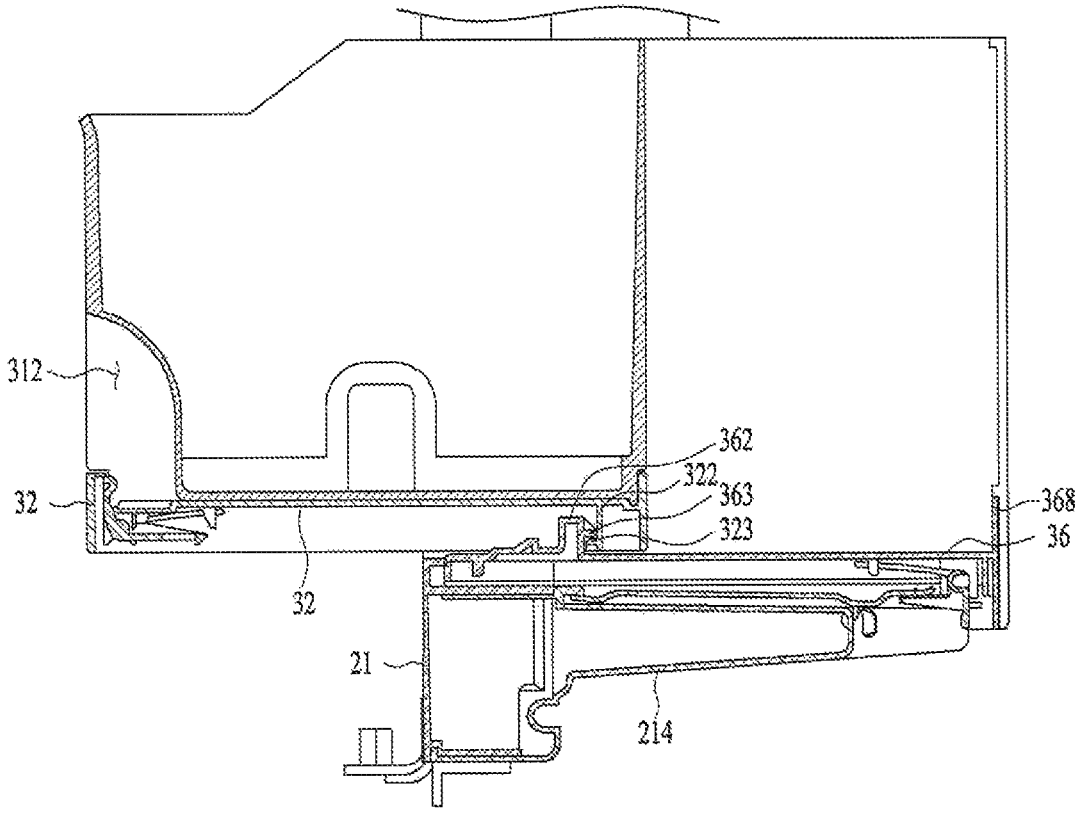
FIG. 15 illustrates a state where the basket is taken out forward.

Referring to FIGS. 14 and 15, the front lever projection 334 may project downward at a slope. The front lever projection 334 may be coupled to the front lever fixing projection 361 provided at the top surface of the rear plate 36.

The front lever fixing projection 361 may be inclined forward and projected from the top surface of the rear plate 36. When the basket 31 moved forward is re-moved backward, the front lever projection 334 may be able to slide along the inclined surface 361*a* of the front lever fixing projection 361 and then pass the front lever fixing projection 361 smoothly. The front lever projection 334 may be hooked to the front lever fixing projection 361 and the forward movement of the front plate 32 may be prevented.

As shown in FIG. 14 (*a*), the basket 31 may be secured to the main door 21 by the front lever 33. The front plate 32 may be fixed by fixing the front fixing projection 50 to the front lever fixing projection 361 provided in the rear plate 36.

As shown in FIG. 14 (*b*), the first angle between the front fixing lever 333 and the front elastic lever 332 may become narrower when an external force is applied to pull the front handle 335 forward. In this instance, the front fixing lever 333 may be rotated upward and the front lever projection 334 may be released from the front lever fixing projection 391 to move the front plate 32 backward.

The refrigerator may further include a handle hole 321 to expose the front handle 335 out the front plate 32 (see FIG. 5). The handle hole 321 may be a hole to allow the top and the bottom of the front plate 32 to communicate with each other. The front handle 335 may be exposed out to the front plate 32 via the handle hole 321. The user may apply force to the front handle 335 provided in the top surface of the front plate 32 forward and then move the basket 31 out in a forward direction.

In the front rail assembly 34, the front first rail 341 may be fixed to the top surface of the rear plate 36 and the front second rail 342 may be fixed to the bottom surface of the front plate 32. Accordingly, the front second rail 342 may be slidingly moved forward by the guide of the front first rail 341. The front plate 32 may be moved out forward as far as the maximum moving distance of the front second rail 342, which may be equal to the maximum forward movement distance of the basket 31.

As shown in FIG. 15, a first stopper 322 may be provided at a back surface of the front plate 32 and a second stopper 362 may be provided at an upper surface of the rear plate 36, so as to prevent the front plate from becoming separated after moved forward (see FIG. 5). Even when the front plate 32 is moved forward, the movement of the first stopper provided in the front plate 32 may be restricted by the second stopper 362 and the front plate 32 may then be prevented from becoming separated from the main door 21 completely.

The refrigerator may further include a rotation preventing unit or device to prevent the basket 31 from being rotated by the rotational force generated by the load of the basket 31. The rotation preventing unit may include a first rotation preventing projection 323 projecting forward from the first stopper 322 and a second rotation preventing projection 363 projecting backward from the second stopper 362.

The second rotation preventing projection 363 may be located beyond the first rotation preventing projection 323, when the front plate 32 is moved out forward by the maximum distance. The rotation of the basket 31 may be prevented by keeping a balance of power even in case of the forward rotational force generated by the load of the basket 31.

When the user pushes the basket 31 having moved out forward backward, the front second rail 342 provided at the bottom surface of the front plate 32 may slide backward along the guide of the front first rail 341. As mentioned above, the movement preventing rib 368 may extend to the top surface of the rear plate 36 and function as a kind of a stopper to prevent the front plate 32 and the basket 31 from moving backward. Meanwhile, the front plate 32 may have the basket 31 located thereon.

Referring to FIG. 5, the top surface of the front plate 32 may be stepped to a preset depth so as to secure the basket 31 and the basket 31 may have a basket step 313 formed at an outer circumference to be insertedly seated in the stepped portion of the front plate 32. The refrigerator may include a coupling projection projected from the top surface of the front plate 32 to secure the basket 31; and a basket coupling recess 314 concavely formed in an outer surface of the basket 31 to be insertedly coupled to the coupling projection 324.

The refrigerator may further include a basket handle recess 312 recessed from a front outer surface of the basket 31. The front handle 335 exposed to the top surface of the front plate 32 may then be exposed to the user via the basket handle recess 312.

Figure 16:
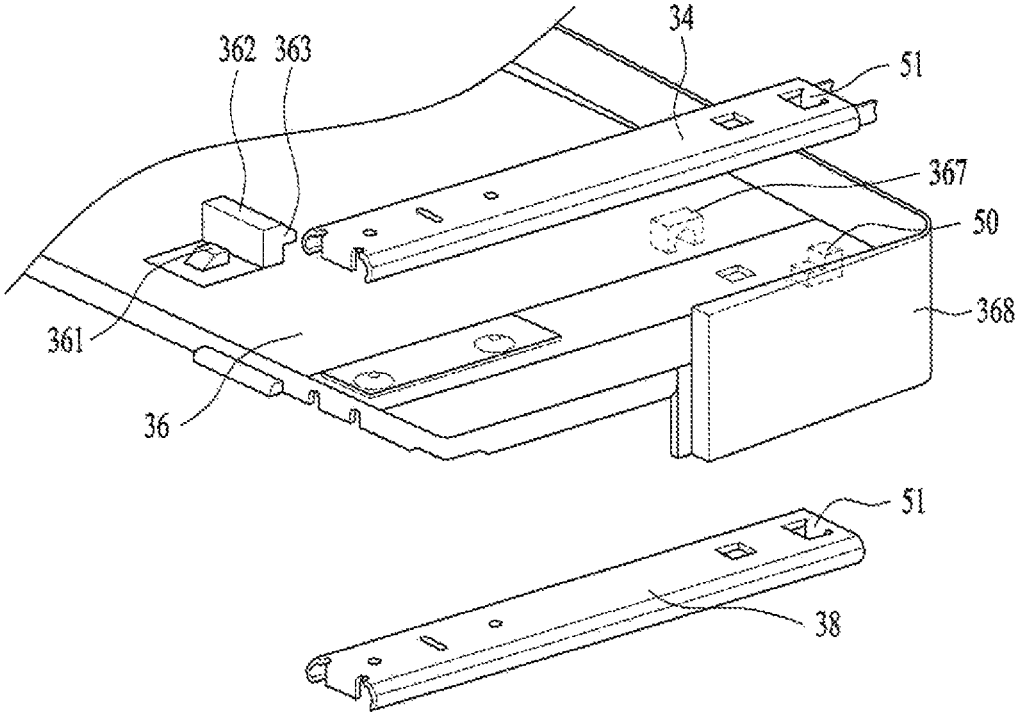
FIG. 16 illustrates a front rail assembly and a rear rail assembly which are coupled to a rear plate.
Figure 17:
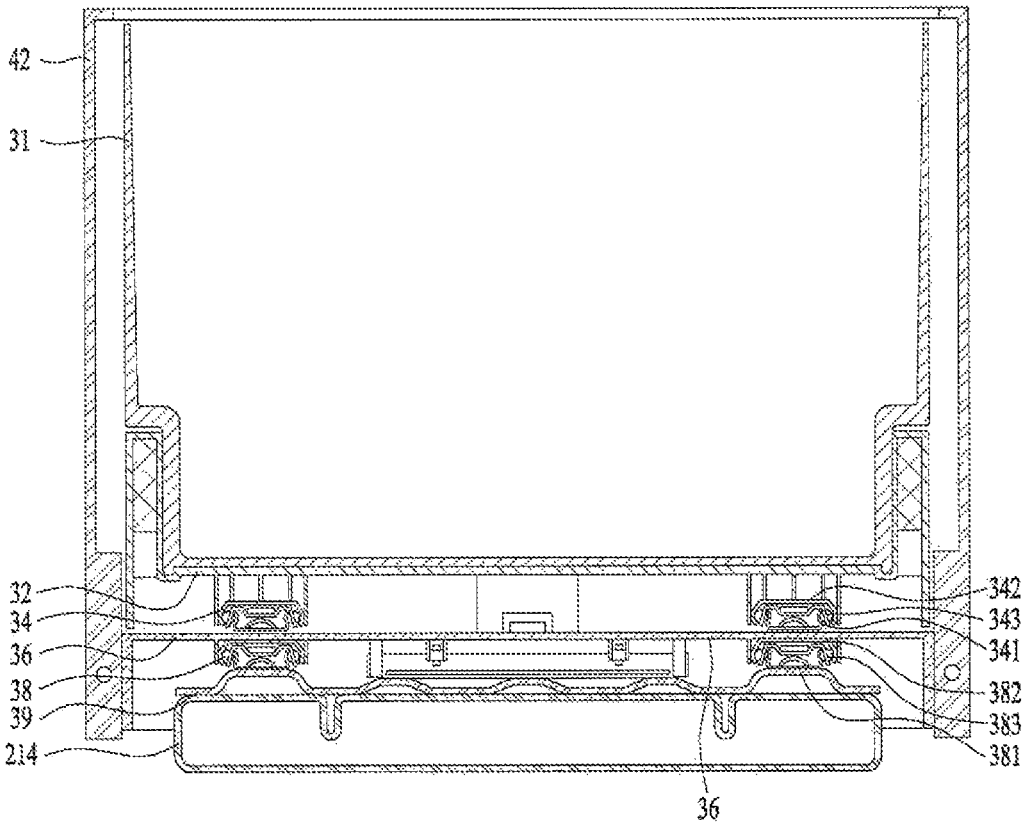
FIG. 17 is a lateral sectional diagram of a basket assembly.

Referring to FIGS. 16 and 17, the front rail assembly 34 and the rear rail assembly 38 may be provided at the top surface and the bottom surface of the front plate 32, respectively. The front first rail 341 and the rear second rail 382 may be fixed to the top surface and the bottom surface of the rear plate 36, respectively.

The front rail assembly and the rear rail assembly may be fixedly arranged above and below on the same vertical line, to reduce the deflection of the basket when the user moves the basket out. In the illustrated example, the front first rail 341, the rear plate 36 and the rear second rail 382 may be fixed together.

The front rail assembly 34 and the rear rail assembly 38 may be provided on the same vertical axis. Accordingly, the load of the basket 31 may be transmitted to the rear rail assembly 38 of the front rail assembly 34 and the reinforcing plate 39 of the rear rail assembly 38.

In this instance, the front first rail 341 may be secured to the front portion of the rear plate 36. This allows for the front second rail 342 guided by the front first rail 341 to slidingly move forward to the maximum distance. For a similar reason, the rear first rail 381 may be coupled to the rear portion of the reinforcing plate 39. This allows for the rear second rail 382 guided by the rear first rail 381 to slidingly move out backward to the maximum distance.

Figure 18:
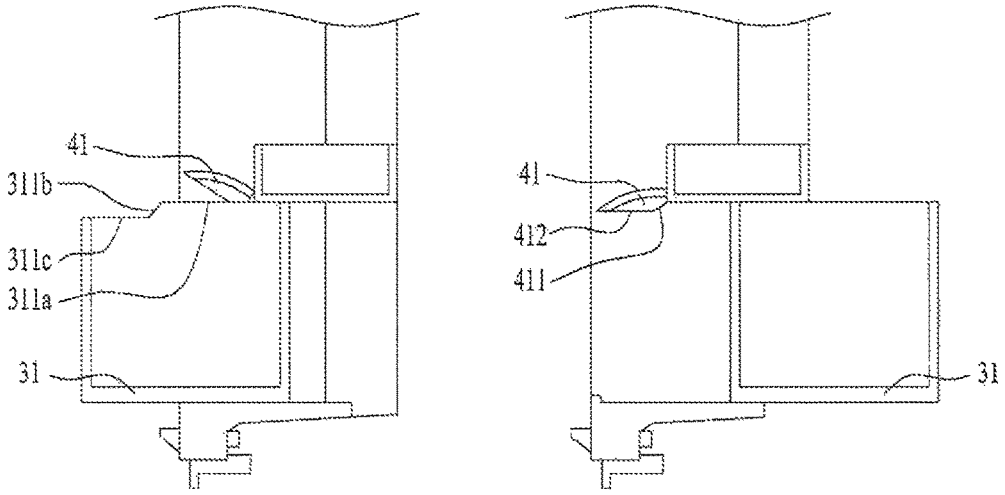
FIG. 18 illustrates operation of a basket cover according to forward or backward moment of the basket.

Referring to FIG. 18 the refrigerator may further include a basket top cover 41 partially covering the top of the basket 31. The basket top cover 41 may be rotatably coupled to the main door 21. Specifically, the basket top cover 41 is vertically rotatably coupled to the door opening 216. As shown in FIG. 18, the basket top cover 41 may be rotatable in the door storage 11*a*.

A top of a lateral wall defining the basket 31 may include a first horizontal line 311*a* provided at a rear portion of the basket 31; a second horizontal line 311*c* provided lower than the first horizontal line 311*a*, in front of the first horizontal line 311*a*; and an inclined line 311*b* connecting the first horizontal line 311*a* and the second horizontal line 311*c* with each other. The basket top cover 41 may be provided at the second horizontal line 311*c*. The basket top cover 41 may cover an open top surface of the basket 31 defined by the second horizontal line 311*c*, specifically, a basket opening 311.

The basket top cover 41 may be horizontally provided when the basket 31 is arranged in the main door 21 or moved out backward. However, the basket top cover 41 may be rotated upward when the basket 31 is moved out forward. The basket top cover 41 may include a slanted portion 411 rotatable by the frictional force generated by the contact with the inclined line 311*b* when the basket 31 is moved forward; and a linear portion 412 connected with the curved portion 411 and fixed by the first horizontal line 311*a*.

A refrigerator may include a basket movable forward from a main-door. A refrigerator may also include a basket movable backward from a main-door.

A refrigerator may be capable of preventing a basket from moving according to door rotation. A refrigerator may have an improved rigidity to minimize the horizontal or vertical shaking of the basket movable forward or backward from a main door.

A refrigerator may comprise a cabinet including a storage compartment provided therein; a main door rotatably coupled to the cabinet and opening and closing the storage compartment; a door opening provided in the main door and in communication with the storage compartment; a sub door opening and closing the door opening; a basket assembly provided in the door opening and comprising a basket movable forward and backward, wherein the basket assembly includes a front plate provided under the basket; a front assembly provided under the front plate and configured to move the front plate forward; a rear plate provided under the front rail assembly; and a rear rail assembly provided under the rear plate and configured to move the rear plate backward. The rear rail assembly may be provided at a lower end of the door opening.

The main door may include a support projected backward therefrom, and the basket assembly may be secured to a top surface of the support. The refrigerator may further include a reinforcing plate provided between the support and the basket assembly.

The support may include a first fixing groove concavely recessed to a front side, and the reinforcing plate may be insertedly fitted to the first fixing groove. The support may further include a second fixing groove concavely recessed to a lateral side, and the reinforcing plate may include a first wing extended from a lateral surface and the first wing is inserted in the second fixing groove.

The reinforcing plate may include a reinforcing rib for reinforcing rigidity. The refrigerator may further include a rear lever fixing the rear plate to prevent the rear plate from becoming movable backward by inertia when the main door is open.

The rear lever may include a rear shaft; a rear handle extended from the rear shaft downward; a rear elastic lever extended from the rear shaft and fixed to the rear plate; a rear fixing lever extended from the rear shaft and forming a second angle with the rear elastic lever; and a rear lever projection provided in the rear fixing lever and selectively fixed to the main door. The rear lever projection may be inclinedly projected upward. When an external force is applied to the rear handle backward, the second angle between the rear fixing lever and the rear elastic lever may be getting wider and then the fixing of the rear lever projection may be released.

The refrigerator may further include a movement preventing rib provided in the rear plate to prevent the rear plate from being moved out. The refrigerator may further include a front lever fixing the front plate to prevent the movement of the front plate.

The front lever may include a front shaft; a front handle extended from the front shaft upward; a front elastic lever extended from the front shaft and fixed to the front plate; a front fixing lever extended from the front shaft and forming a first angle with the front elastic lever; and a front lever projection provided in the front fixing lever and selectively fixed to the rear plate. The front lever projection may be inclinedly projected downward. When an external force is applied to the front handle forward, the first angle between the front fixing lever and the front elastic lever may be getting narrower and then the fixing of the front lever projection may be released.

The refrigerator may further include a front lever fixing projection provided in a top surface of the rear plate and fixing the front lever projection. The front lever fixing projection may be projected upward and have one surface inclined upward.

A first stopper may be provided in a bottom surface of the front plate and a second stopper may be provided in a top surface of the rear plate, so as to prevent the front plate from being separated after moved out. The first stopper may include a first rotation preventing projection projected forward and the second stopper may include a second rotation preventing projection projected backward, and the rotational force generated by the load of the basket may be stopped by locating the second rotation preventing projection beyond the first rotation preventing projection when the front plate is moved forward to the maximum distance.

The front rail assembly may include a front first rail having a '⊏' shape; a front second rail provided in the front first rail and having a '⊏' shape larger than 'the shape of the front first rail; a front third rail provided between the front first rail and the front second rail and comprising a ball bearing in contact with the front first rail and the front second rail. The front rail assembly may include a rear first rail having a '⊏' shape; a rear second rail provided in the rear first rail and having a '⊏' shape larger than the shape of the rear first rail; and a rear third rail provided between the rear first rail and the rear second rail and including a ball bearing in contact with the rear first rail.

The rear second rail, and the front first rail, the rear plate and the rear second rail may be fixed together. A top of a lateral wall for defining the basket may include a first horizontal line provided in a rear portion of the basket; a second horizontal line in front of and lower than the first horizontal line; and an inclined line connecting the first horizontal line and the second horizontal line with each other.

The refrigerator may further include a basket top cover provided in a top of the second horizontal line and covering the top of the basket. The basket top cover may rotatably provided in the main door. The basket top cover may be rotated upward by the inclined line when the basket is moved forward.

The refrigerator having the basket movable forward from the main door may be provided. Furthermore, the refrigerator having the basket movable backward from the main door may be provided.

Still further, the refrigerator may prevent the movement of the basket according to the rotation of the door. Still further, the refrigerator may minimize the up-and-down or right-and-left shaking of the basket when the user moves out the basket forward or backward from the main door.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:
- a cabinet having a storage compartment;
- a main door rotatably coupled to the cabinet to open and close the storage compartment;
- a door opening provided in the main door and in communication with the storage compartment;
- a sub door to open and close the door opening; and
- a basket assembly provided in the door opening and including a basket movable forward and backward, wherein the basket assembly includes:
  - a front plate provided under the basket;
  - a front rail assembly provided under the front plate and configured to move the front plate forward;
  - a rear plate provided under the front rail assembly; and
  - a rear rail assembly provided under the rear plate and configured to move the rear plate backward, wherein the main door includes a support projected backward from the main door, and the basket assembly is secured to a top surface of the support.

2. The refrigerator of claim 1, further including a reinforcing plate provided between the support and the basket assembly.

3. The refrigerator of claim 2, wherein the support includes a first fixing groove concavely recessed to a front side, and the reinforcing plate is insertedly fitted to the first fixing groove.

4. The refrigerator of claim 2, wherein the support further includes a second fixing groove concavely recessed to a lateral side, and the reinforcing plate includes a first wing extending from a lateral surface, wherein the first wing is inserted in the second fixing groove.

5. The refrigerator of claim 1, further including a rear lever fixing the rear plate to prevent the rear plate from moving backward by inertia when the main door is open.

6. The refrigerator of claim 5, wherein the rear lever includes:
- a rear shaft;
- a rear handle extending from the rear shaft downward;
- a rear elastic lever extending from the rear shaft and fixed to the rear plate;
- a rear fixing lever extending from the rear shaft and forming a first angle with the rear elastic lever; and
- a rear lever projection provided at the rear fixing lever and selectively fixed to the main door.

7. The refrigerator of claim 6, wherein the rear lever projection is inclinedly projected upward in a front direction.

8. The refrigerator of claim 6, wherein when an external force is applied to the rear handle backward, the first angle between the rear fixing lever and the rear elastic lever becomes wider to release the rear lever projection.

9. The refrigerator of claim 1, further including a movement preventing rib provided at the rear plate to prevent the rear plate from being moved out.

10. The refrigerator of claim 1, further including a front lever fixing the front plate to prevent movement of the front plate.

11. The refrigerator of claim 10, wherein the front lever includes:
- a front shaft;
- a front handle extending from the front shaft upward;
- a front elastic lever extending from the front shaft and fixed to the front plate;
- a front fixing lever extending from the front shaft and forming a second angle with the front elastic lever; and
- a front lever projection provided at the front fixing lever and selectively fixed to the rear plate.

12. The refrigerator of claim 11, wherein the front lever projection is inclinedly projected downward in a rear direction.

13. The refrigerator of claim 12, wherein when an external force is applied to the front handle forward, the second angle between the front fixing lever and the front elastic lever becomes narrower to release the front lever projection.

14. The refrigerator of claim 12, further including a front lever fixing projection provided in a top surface of the rear plate and fixing the front lever projection.

15. The refrigerator of claim 14, wherein the front lever fixing projection is projected upward and has one surface inclined upward in a front direction.

16. The refrigerator of claim 1, wherein a first stopper is provided at a bottom surface of the front plate and a second stopper is provided at a top surface of the rear plate, so as to prevent the front plate from being separated after being moved out.

17. The refrigerator of claim 16, wherein the first stopper includes a first rotation preventing projection projecting forward and the second stopper includes a second rotation preventing projection projecting backward, and the rotational force generated by the load of the basket is stopped by locating the second rotation preventing projection beyond the first rotation preventing projection when the front plate is moved forward to a maximum distance.

18. The refrigerator of claim 1, wherein the front rail assembly includes:
- a front first rail having a '⊏' shape;

a front second rail provided in the front first rail and having a '⊏' shape larger than the shape of the front first rail; and a front third rail provided between the front first rail and the front second rail and including a first ball bearing in contact with the front first rail and the front second rail, and wherein the rear rail assembly includes:

a rear first rail having a '⊏' shape;

a rear second rail provided in the rear first rail and having a '⊏' shape larger than the shape of the rear first rail; and a rear third rail provided between the rear first rail and the rear second rail and including a second ball bearing in contact with the rear first rail and the rear second rail, wherein the front first rail, the rear plate and the rear second rail are fixed together.

19. The refrigerator of claim 1, wherein a top of a lateral wall that defines the basket includes a first horizontal edge provided at a rear portion of the basket; a second horizontal edge in front of and lower than the first horizontal edge; and an inclined edge connecting the first horizontal edge and the second horizontal edge with each other.

20. The refrigerator of claim 19, wherein a basket top cover is rotatably provided in the main door and covers the top of the basket by resting on the second horizontal edge.

21. The refrigerator of claim 20, wherein the basket top cover is rotated upward by the inclined line when the basket is moved forward.

* * * * *